US005143365A

United States Patent [19]

Green

[11] Patent Number: 5,143,365

[45] Date of Patent: * Sep. 1, 1992

[54] PAPER SHEET FEEDING APPARATUS

[76] Inventor: Ronald J. Green, E11412B North Reedsburgh Rd., Baraboo, Wis. 53913

[ * ] Notice: The portion of the term of this patent subsequent to Feb. 12, 2008 has been disclaimed.

[21] Appl. No.: 636,597

[22] Filed: Jan. 2, 1991

Related U.S. Application Data

[63] Continuation-in-part of Ser. No. 393,135, Aug. 14, 1989, Pat. No. 4,991,831.

[51] Int. Cl.[5] ..... B65H 3/52; B65H 7/04; B65H 7/14

[52] U.S. Cl. ..... 271/121; 271/110; 271/125

[58] Field of Search ..... 271/35, 109, 110, 117, 271/121, 124, 125, 137, 138

[56] References Cited

U.S. PATENT DOCUMENTS

| | | | |
|---|---|---|---|
| 1,065,945 | 7/1913 | Jahn | 271/124 |
| 1,078,281 | 11/1913 | Hay | 271/137 |
| 1,596,056 | 8/1926 | Mader | 271/124 |
| 2,368,519 | 1/1945 | Burchhardt et al. | 271/125 |
| 2,635,874 | 4/1953 | LaBore . | |
| 3,372,923 | 3/1968 | Watson et al. | 271/23 |
| 3,425,685 | 2/1969 | Liva | 271/21 |
| 3,525,518 | 8/1970 | Oaten | 271/121 |
| 3,578,313 | 5/1971 | Eppinger | 271/121 |
| 3,612,511 | 10/1971 | Godlewski | 271/35 |
| 3,748,937 | 7/1973 | Long | 83/12 |
| 3,831,928 | 8/1974 | Davis | 271/35 |
| 3,838,851 | 10/1974 | Kolibas | 271/124 |
| 3,908,983 | 9/1975 | Long | 271/35 |
| 3,933,350 | 1/1976 | Mignano | 271/10 |
| 3,975,010 | 8/1976 | Schisselbauer et al. | 271/121 |
| 3,991,998 | 11/1976 | Banz et al. | 271/125 |
| 4,050,690 | 9/1977 | Michelson | 271/125 |
| 4,083,555 | 4/1978 | Irvine et al. | 271/10 |
| 4,437,658 | 3/1984 | Olson | 271/125 |
| 4,462,586 | 7/1984 | Browne et al. | 271/94 |
| 4,529,187 | 7/1985 | Einem et al. | 271/10 |
| 4,557,472 | 10/1985 | Hannon | 271/133 |
| 4,560,158 | 12/1985 | Wilson | 271/165 |
| 4,606,535 | 9/1986 | Larson | 271/10 |
| 4,607,832 | 8/1986 | Abe | 271/10 |
| 4,715,593 | 12/1987 | Godlewski | 271/10 |
| 4,858,907 | 8/1989 | Eisner et al. | 271/124 |
| 4,991,831 | 2/1991 | Green | 271/121 |

FOREIGN PATENT DOCUMENTS

| | | | |
|---|---|---|---|
| 2638260 | 3/1977 | Fed. Rep. of Germany . | |
| 3030489 | 3/1981 | Fed. Rep. of Germany . | |
| 2627763 | 9/1989 | France . | |
| 123731 | 5/1988 | Japan | 271/124 |
| 63-258330 | 10/1988 | Japan . | |
| 7036 | 3/1898 | United Kingdom | 271/124 |
| 1029294 | 5/1966 | United Kingdom . | |

*Primary Examiner*—Robert P. Olszewski
*Assistant Examiner*—Steven M. Reiss
*Attorney, Agent, or Firm*—Bell, Seltzer, Park & Gibson

[57] ABSTRACT

Disclosed is a sheet feeder device including means for supporting a generally vertical stack of sheets. The supporting means include endless belts having an upper belt run position to extend across the bottom of the stack of sheets. A stationary gate forming member is provided which is positioned above the upper run of the belts and adjacent the forward side of the stack to define a nip which forms a gap between the gate forming member and the upper run for permitting the lowermost sheet of the stack to pass forwardly from the stack through the nip. The gate forming member is a cylindrical roll defining a central axis and an outer peripheral surface which is concentric to the central axis. The roll has a groove extending axially along the length thereof. An elastomeric bar is disposed in the groove, and the bar has a coefficient of friction which is higher than that of the material of the roll. Also, the bar is sized so as to extend radially beyond the peripheral surface. This portion of the bar includes a rearwardly facing edge surface which extends generally along a tangent to the outer peripheral surface of the roll. In operation, the lowermost sheet is fed by the endless belts through the nip without engaging the bar and without significant frictional resistance, while the sheet immediately above the lowermost sheet engages the bar and is retarded in its advance by its engagement with the material of the bar.

22 Claims, 3 Drawing Sheets

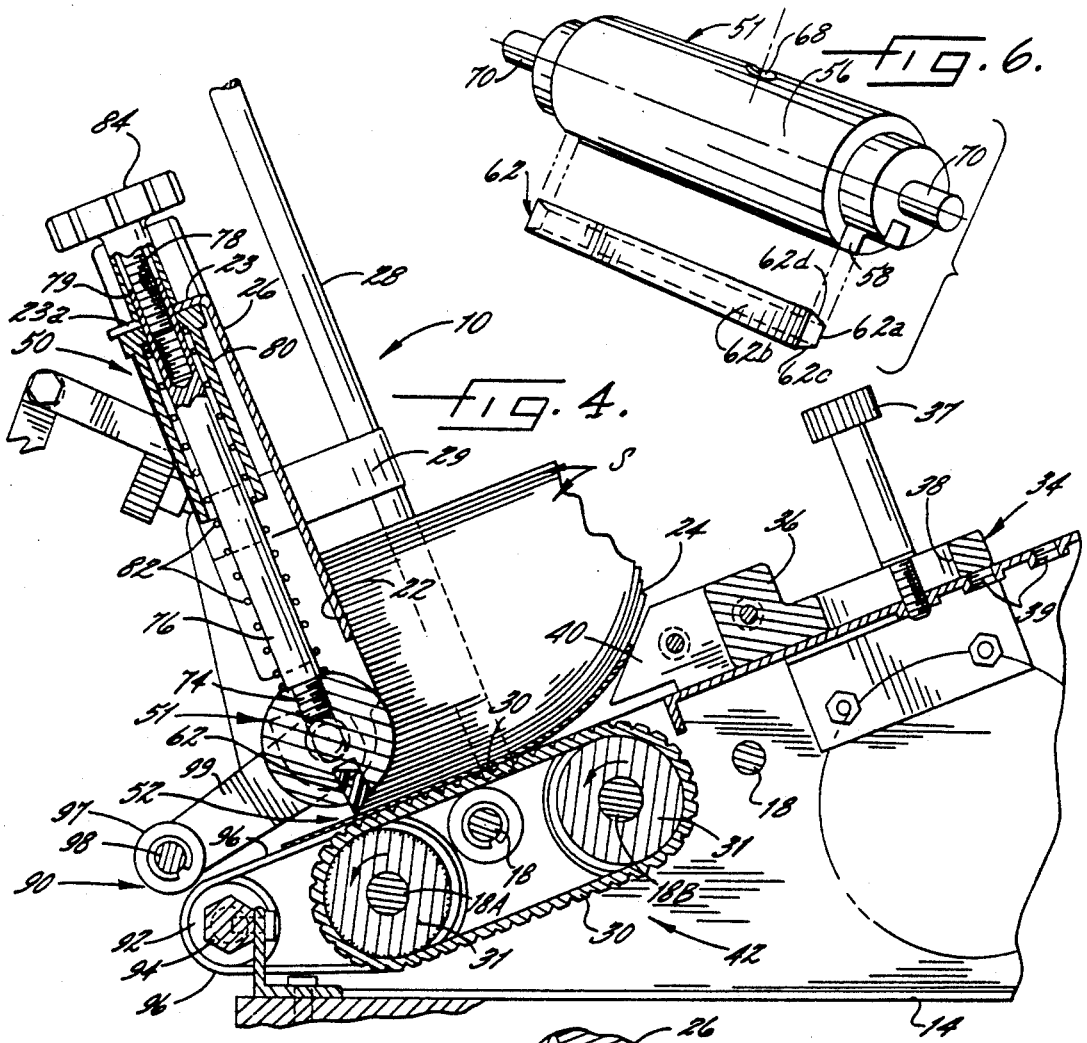
FIG. 4.
FIG. 6.
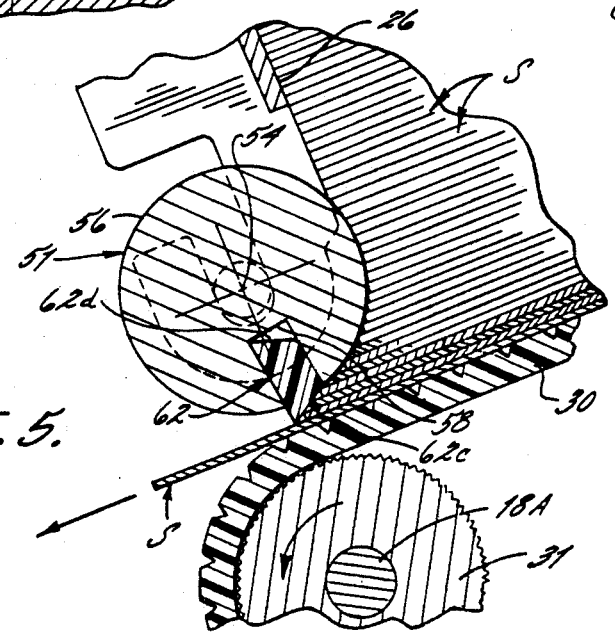
FIG. 5.

PAPER SHEET FEEDING APPARATUS

This application is a continuation-in-part of U.S. Pat. application Ser. No. 07/393,135 filed Aug. 14, 1989 for "Paper Sheet Feeding Apparatus" now U.S. Pat. No. 4,991,831. The disclosure of that application is incorporated herein by reference.

FIELD OF THE INVENTION

This invention generally relates to paper feeding apparatus and, more particularly, to an apparatus for serially feeding flat sheets of paper from the bottom of a vertical stack of such sheets and so on to permit subsequent processing of each individual sheet.

BACKGROUND OF THE INVENTION

Generally, sheet feeding devices capable of high speed feeding are relatively complicated, and require a large number of complex and interrelated moving parts which are subject to wearing out and failure.

Most known sheet feeders cannot dispense sheets in a shingled manner, but rather, only one sheet at a time. The ability to shingle sheets would greatly increase the efficiency of any feeder device, however, most feeder devices lack this ability. Also, most friction feed devices have problems feeding coated and slick stacks.

Prior sheet feeder devices use suction cups to engage the bottom of the sheet being fed. The suction cups then pull the sheet downward and a separator member holds the sheet downward by inserting itself between the stack of sheets and the suctioned sheet. Then, a gripper arm member pulls the suctioned piece out and drops the sheet onto a conveyor belt for individual processing. The use of the suction cup presents numerous problems for different applications. For example, if the sheet being fed is a folded sheet of paper, the suction cup can adhere only to the lower portion of the folded paper. Consequently, the separator member does not separate between two separate sheets in the stack but rather between different folds of the same sheet.

Another problem with the suction cup method is that it is unable to adequately perform when the sheets are made of a stiff material rather than a flexible material since the suction is not strong enough to bend the sheet.

Yet another problem with prior sheet feeder devices is the wearing out of parts of the device. In devices with a stationary top roller, this top roller often wore out and was expensive and inconvenient to replace.

Still another problem with earlier sheet feeders is the separation of sheets having a static electrical charge. These sheets tend to resist separation resulting in multiple sheets per package.

An additional problem with prior devices includes the inability to use tall stacks of sheets because of the resulting increase in pressure upon sheets at the bottom of the stack.

SUMMARY OF THE INVENTION

It is an object of the present invention to provide for a reliable and efficient sheet feeding apparatus of the described type.

Another object of the present invention is to provide a sheet feeding apparatus capable of handling different types and sizes of paper sheets, including coated and slick sheets.

It is yet another object of the present invention to provide a sheet feeding apparatus which can shingle feed the sheets.

Still another object of the present invention is to provide a sheet feeding apparatus which can efficiently separate sheets bearing a static electrical charge.

Yet another object of the invention is to provide a sheet feeding apparatus which allows for large sheet stacks.

These and other objects and advantages of the present invention are achieved by the provision of an apparatus which comprises means for supporting a generally vertical stack of sheets so that the stack defines a forward side composed of aligned forward edges of the sheets and a bottom. The supporting means include endless belt means and means for mounting the endless belt means so as to have an upper belt run positioned to extend across the bottom of the stack of sheets. The apparatus also includes driving means for rotating the endless belt means so that the upper run moves in the forward direction. A stationary gate forming member is provided which is positioned above the upper run of the belt means and adjacent the forward side of the stack thereby defining a nip which forms a gap between the gate forming member and the upper run for permitting the lowermost sheet of the stack to pass forwardly from the stack through the nip.

The gate forming member is preferably a cylindrical roll defining a central axis and an outer peripheral surface which is concentric to the central axis. The roll has a groove extending along the length thereof, and the groove is disposed so as to generally oppose the nip. The cylindrical roll also has a bar disposed in the groove. The bar is of a material having a higher coefficient of friction than the material of the cylinder. The bar is preferably of a trapezoid shape and one end portion of the bar extends beyond the outer peripheral surface of the cylinder. The surface portion extended beyond the roll surface includes a rearwardly facing and generally planar edge surface which extends generally along a tangent to the outer peripheral surface.

In one preferred mode of operation, the gap formed between the bar and the upper rim of the belt means at the nip is adjusted to allow the lowermost sheet to freely pass therethrough, and so that the sheet above the lowermost sheet frictionally engages the rearwardly facing edge surface of the bar at the nip and is retarded thereby. When the lowermost sheet has been fed forwardly a sufficient distance to permit the overlying sheet to contact the endless belt means, the overlying sheet is then driven forwardly into the nip to form a tight fit, and which in turn causes the sheets to be shingled as they are fed from the stack.

The sheet feeder device of the present invention may also include one or more guide means for ensuring that the sheet being fed is guided to its correct position on a conveyor belt or the like. The device may also include a photocell for sensing when a sheet is not in the process of being fed and then signaling the drive means to start the belt running so as to feed additional sheets.

BRIEF DESCRIPTION OF THE DRAWINGS

Some of the objects and advantages of the present invention having been stated, others will appear as the description proceeds, when taken in conjunction with the accompanying drawings in which:

FIG. 4 is a fragmentary side sectional view of the apparatus and taken along line 4—4 of FIG. 2.

FIG. 5 is an enlarged view of a portion of FIG. 4.

FIG. 6 is a perspective detailed view of the gate forming member of the apparatus.

DETAILED DESCRIPTION OF THE PREFERRED EMBODIMENT

Figure 1:
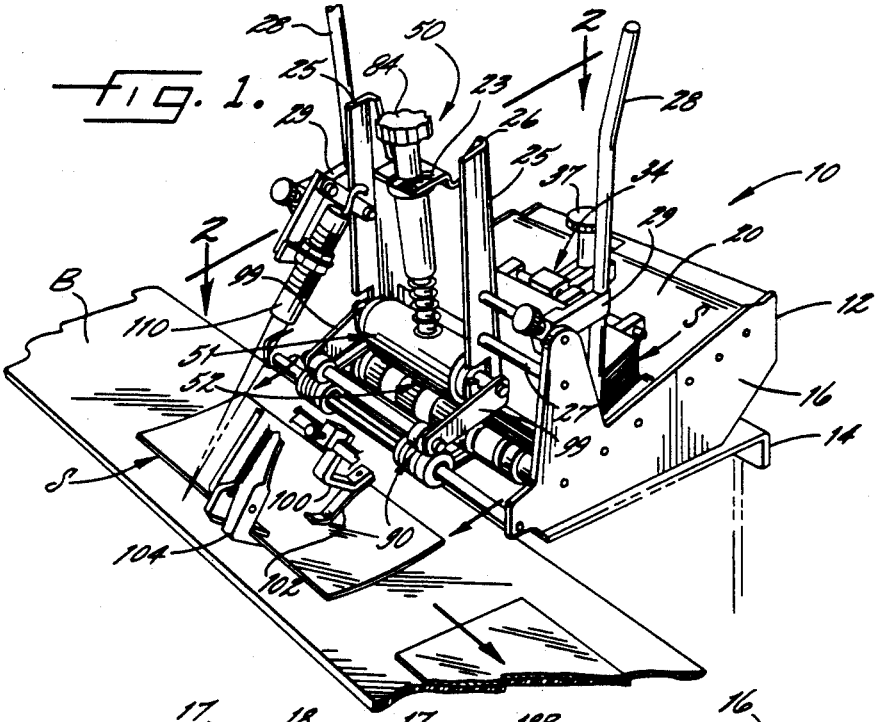
FIG. 1 is a perspective view of a sheet feeding apparatus which embodies the features of the present invention.

Referring more particularly to the drawings, an apparatus for serially feeding sheets of paper from a bottom of a generally vertically stack of such sheets, and which embodies the features of the present invention, is indicated generally at 10. The apparatus 10 is shown in use as a part of a sheet feeding system, and wherein the sheets S are fed laterally from the bottom of the stack onto a moving conveyor belt B, and so that the sheets may be subsequently collated with other sheets, or placed in mailing envelopes, in a conventional manner.

The apparatus 10 comprises a rigid frame 12 which includes a base plate 14, a pair of upright side plates 16 which are joined to the base plate, and a number of transverse rods 18 extending between and interconnecting the side plates. The transverse rods 18A and 18B are mounted by means of bearings 17 to the side walls, note FIG. 2, so as to permit the free rotation thereof. The remaining transverse rods are fixedly mounted to the side walls. Also, the frame includes a rear cover plate 20 which extends between the side plates 16 and is connected thereto at the rear portion of the frame.

Figure 3:
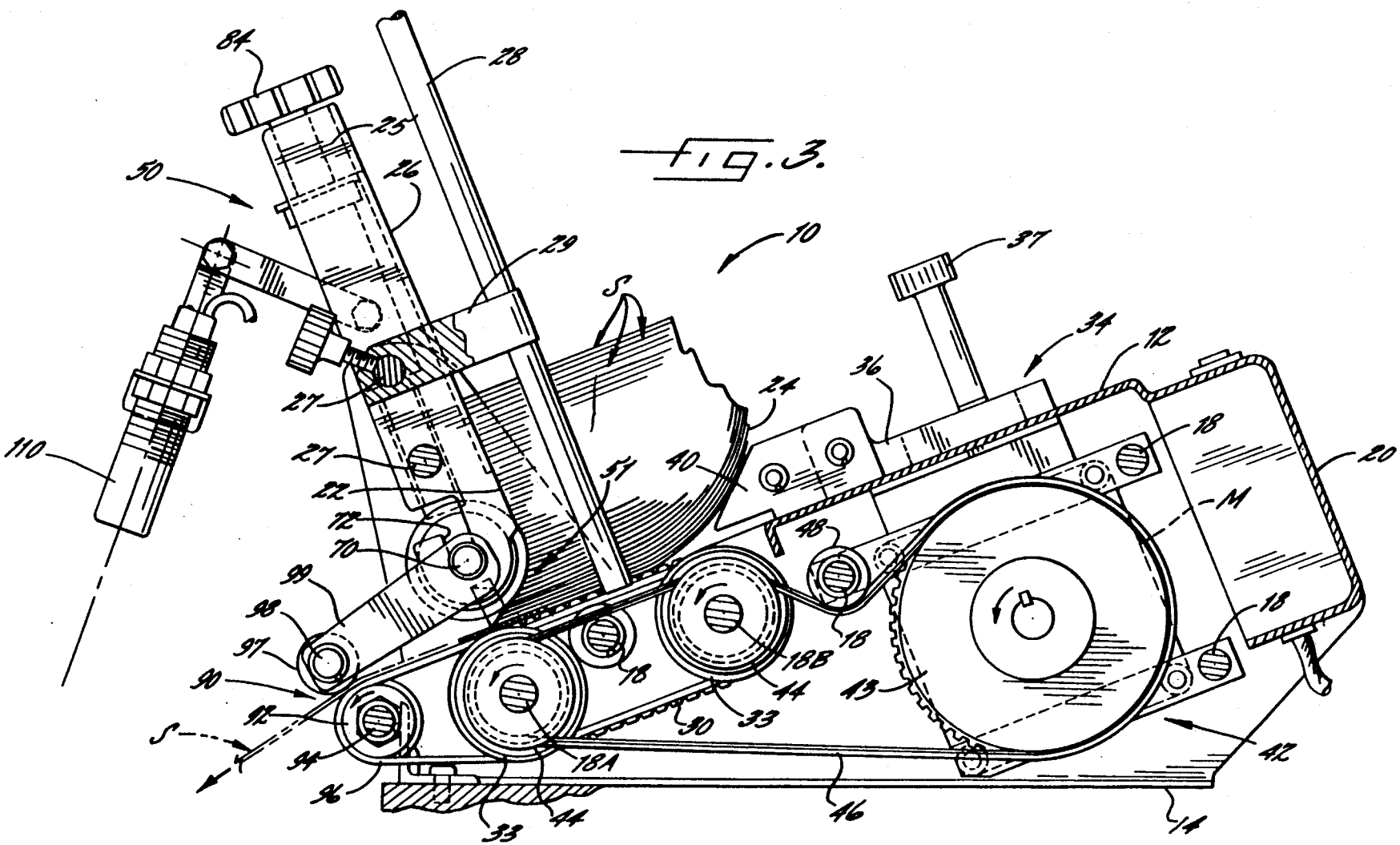
FIG. 3 is a side sectional view of the apparatus taken along line 3—3 of FIG. 2.

The apparatus 10 further comprises means for supporting a generally vertical stack of rectangular sheets S of paper. As best seen in FIG. 3, the supported stack defines a forward side 22 composed of aligned forward edges of the sheets, as well as the opposite rear side 24 composed of the aligned rearward edges of the sheets. The forward side of the stack is supported in the forward direction by a generally vertically extending front support plate 26. The front support plate includes inturned opposite sides 25, which are fixedly secured to the frame by transverse rods 27. The upper portion of the support plate includes a generally horizontal mounting bracket 23 having a forwardly extending slot **23*a* for the purposes described below The means for supporting the vertical stack of paper sheets also includes a pair of vertical rods 28 which support respective opposite ends of the stack, and the rods are each mounted to the frame by an arm 29 which is fixed to the associated vertical rod, and which is coupled to a transverse rod 27 by an opening which receives the transverse rod, and a threaded member, so as to permit the separation of the rods 28** to be laterally adjusted. Thus the rods are able to accommodate stacks of sheets of different length therebetween.

The stack supporting means further includes endless belt means, and which comprises, in the illustrated embodiment, three endless belts 30, and a pair of aligned support rolls 31 (FIG. 4) mounted on respective ones of said support shafts 18A, 18B for mounting each of said endless belts. A plurality of drive rolls 33 are mounted on each of said support shafts 18A, 18B, with one of said drive rolls being positioned on each shaft between adjacent endless belts. The diameter of the support rolls 31 is less than the diameter of the drive rolls 33 so that said drive rolls have an outer surface which is substantially coextensive with the outer surface of said endless belts. The support rolls 31 are positioned such that the three belts 30 define coplanar upper runs which extend across the bottom of the stack. The belts 30 bridge the space between the drive rollers 33, and the belts 30 and drive rollers 33 serve to convey the sheets forwardly to the nip area in the manner further described below.

The stack supporting means also includes a rear support member 34 which is positioned above the upper runs of the three belts and below the rear side of the stack of sheets. The rear support member includes a bracket 36 which is releasably connected to the rear cover plate 20 by means of a threaded member 37 which extends through a slot 38 in the bracket and which threadedly engages a selected one of three threaded openings 39 in the rear cover plate. The bracket also includes four forwardly extending fingers 40 which underlie the rear side of the stack of sheets. The fingers each have an inclined forward edge as best seen in FIGS. 3 and 4, so as to lift the rear side of the stack upwardly from the upper run of the three belts. The lateral position of the bracket and the fingers is thereby adjustable so as to permit accommodation of sheets of differing widths.

The three belts 30 and drive rollers 33 are rotated by a drive system 42 so that the upper runs move in a right to left (or forward) direction as seen for example in FIG. 4. This drive system includes an electric motor M which is mounted to the frame of the apparatus beneath the rear cover plate, and which includes an output drive pulley 43. The drive system further includes drive pulleys 44 fixedly mounted on each of the two transverse rods 18A and 18B, and an endless drive belt 46 entrained about the three drive pulleys. Also, a follower pulley 48 is provided which engages the belt at a location between the pulleys 43 and 44 to ensure proper and firm engagement therewith.

The apparatus 10 further includes a stationary gate forming member 50 positioned above the upper runs of the three belts, and adjacent the forward side of the stack of sheets, and so as to define a nip 52 between the gate forming member 50 and the upper runs of the belts 30 and the forward drive rollers 33 on the rod 18A. In the illustrated embodiment, the gate forming member comprises a generally cylindrical roll 51 defining a central axis 54 and an outer peripheral surface 56 which is concentric to the central axis. Also, the roll 51 has a groove 58 extending axially along the length thereof and which is positioned so as to generally oppose the nip. The groove 58 is of generally rectangular cross-section, and as best seen in FIG. 5, it includes opposing generally radially directed side walls, and a transverse bottom wall.

The roll 51 has a bar 62 disposed in the groove 58. The bar 62 has a generally trapezoidal shape in cross-section, so as to define parallel side edges **62*a* and 62*b*, and oppositely inclined bottom and upper edges 62*c* and 62*d* respectively. The portion of the bar which includes the bottom edge 62*c* extends beyond the peripheral surface 56 at the nip, and such that the bottom edge 62*c* defines a rearwardly facing, generally planar edge surface which extends generally along a tangent to the outer peripheral surface 56. Also, the lowermost point of the edge surface 62*c* is positioned generally on a line which extends between the axis 54 of the roll 51 and the axis of the rod 18A, note FIG. 5. The bar is sized so that the bar's two side edges 62***a*, 62*b* are pressed into engagement with the opposing side walls of groove 58 and so as to permit the removal and replacement thereof so that the upper edge 62*d* extends from the groove 58 and defines the rearwardly facing edge surface. This feature is advantageous in that it permits the bar to be repositioned to expose the edge 62*d* should the original edge 62*c* become worn in use.

The bar 62 is composed of a material having a higher coefficient of friction than that of the material of the roll.

In a preferred embodiment, the roll is formed of an acetal or metallic material having a coefficient of friction of about 0.15–0.35 and the bar is formed of an elastomeric material having a coefficient of friction of about 0.5–0.7. As those skilled in the art are aware, other materials for the roll and bar may also be used. This embodiment is especially suited for the processing of sheets bearing a static electrical charge or for operations where a large stack of sheets is being processed. Here, the elastomeric bar 62 provides a large surface to dissipate the sheets' charge before feeding, in contrast to the parent application cited above in which the rings do not provide such a large surface. For large stacks of sheets, the bar provides additional retarding surface to help overcome any additional pressure on the lowermost sheets.

The apparatus includes means for mounting the roll 51 so as to permit the dimension of the nip 52 between the roll and endless belts 30 and rollers 33 to be adjusted. The ability to adjust the nip allows for the single feeding of various thicknesses of sheets. More particularly, the roll includes a central portion 66 and a threaded radial opening 68 which extends into the central portion on the side opposite the bar, note FIG. 6. Also, the opposite ends of the roll include coaxial mounting posts 70, which are received within respective ones of the vertically extending slots 72 in the sides 25 of the front support plate 26. A threaded rod 74 is threadedly received in the opening 68, and the threaded rod includes an upper portion 76 which extends through the slot 23*a* in the mounting bracket 23. This upper end portion is formed with an internally threaded axial bore 78, and a sleeve 80 and a spring 82 coaxially surround the rod below the mounting bracket 23, with the sleeve having an upper end which engages the underside of the bracket 23. The spring is under compression, so as to bias the roll 51 downwardly with respect to the bracket. This downward movement is limited by a control knob 84 which has a threaded member engaged in the bore 78 at the upper portion of the rod, and an outer concentric sleeve 79 for engaging the upper side of the mounting bracket. Thus rotation of the control knob tends to raise or lower the roll with respect to the bracket, and to thus change the vertical dimension of the gap at the nip 52 formed between the roll 51 and the endless belts 30 and rollers 33. Also, the spring will be seen to bias the roll toward the nip and it permits limited upward movement of the roll away from the nip and against the force of the spring.

The above-described mounting means for the roll 51 also permits the quick release and removal of the roll assembly which includes the roll 51, rod 74, sleeve 80, and control knob 84, to thereby facilitate replacement or adjustment of the bar 62 as described above. More particularly, the assembly may be released and removed by lifting the roll 51 so that the mounting posts 70 are removed from the slots 72 in the sides 25 of the plate 26, and then slipped forward from the slot 23*a*.

Figure 2:
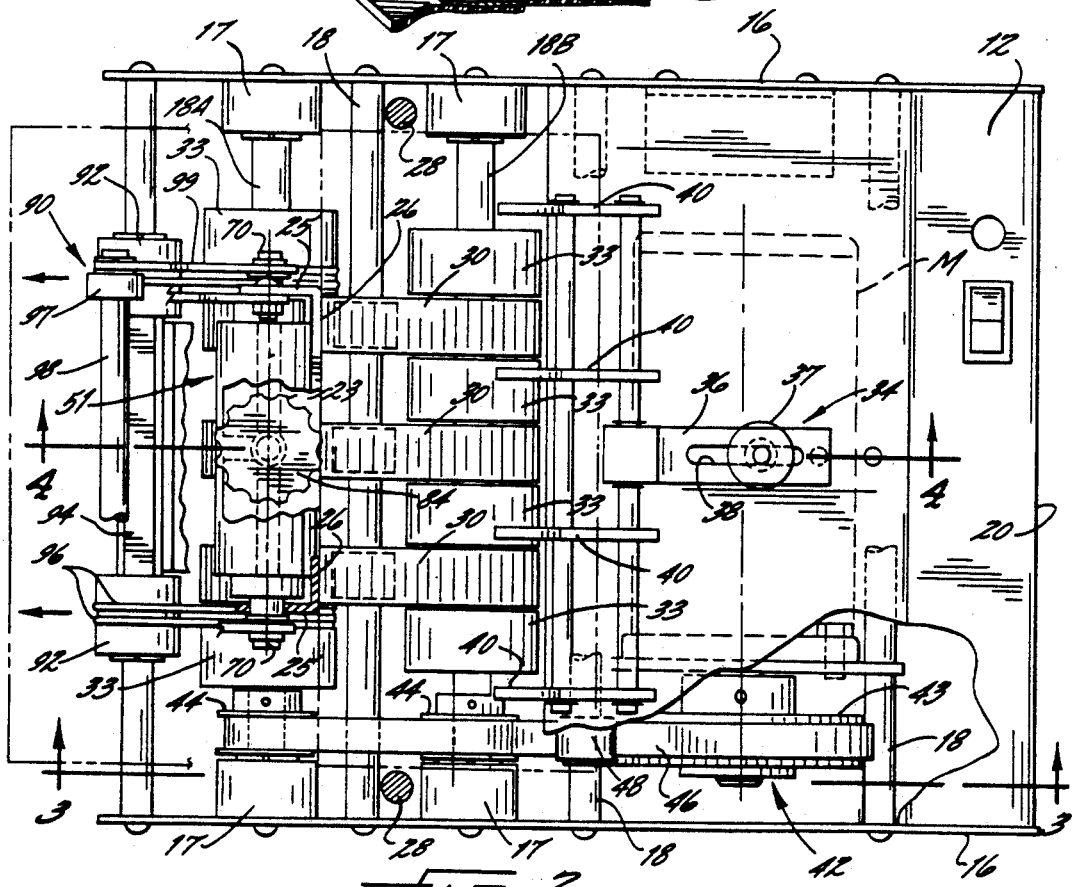
FIG. 2 is a top plan view of the apparatus as viewed along the line 2—2 in FIG. 1.

The apparatus further comprises sheet guide means 90 positioned downstream of and in registry with the nip for guiding the sheets forwardly after advancing through the nip. This sheet guide means, as seen in FIG. 2–4, comprises two laterally spaced apart guide roller segments 92 which are mounted for rotation about the transverse rod 94, which is disposed parallel to the axes of the rods 18A and 18B. The upper portions of the guide roller segments are substantially coplanar with the upper run of the three endless belts 30, and a transmission is provided for operatively connecting the drive motor with the guide roller segments, so that the guide roller segments rotate at a peripheral speed corresponding to the speed of the three endless belts 30 and rollers 33. This transmission comprises a pair of guide belts 96 entrained about each support roll segment and the adjacent roller 33 with the guide belts having an upper run which is substantially coplanar with the upper runs of the three endless belts.

The sheet guide means 90 further comprises a pair of clamping roller segments 97, which are mounted on a support rod 98 which is positioned along an axis parallel to the axis of the guide roller segments 92 so that the clamping roller segments rest upon the peripheral surface of respective ones the guide roller segments. The clamping roller segments are freely rotatable, and the rod is supported by means of a pair of lever arms 99 which are pivotally mounted on respective posts 70 of the roll 51, as best seen in FIG. 1, and so that the clamping roller segments rest from their own weight upon the guide roller segments 92.

To assist in properly delivering the sheets onto the conveyor belt B, at least one sheet guiding member 100 is positioned downstream of the nip and downstream of the sheet guiding means as seen in FIG. 1. The sheet guiding member is fixedly mounted above the conveyor belt, and it includes a downwardly inclined surface portion 102 for engaging the leading edge of each sheet and guiding the same towards an oscillating gripper 104 of conventional design. More particularly, the gripper is programmed to oscillate toward the clamping roller segments to engage the leading edge of each sheet, and then oscillate rearwardly while engaging the leading edge and so as to accurately position the sheet on the conveyor belt B.

A photocell 110 is mounted on the apparatus to control the operation thereof. More particularly, in one possible mode of operation, when no sheet is detected by the photocell, the motor is actuated so as to rotate the endless belts 30 and drive rollers 33 a controlled distance which is calculated to deliver a single sheet through the nip. Concurrently, the gripper 104 is oscillated toward the apparatus to catch the leading edge of the sheet, and then oscillate rearwardly to its release position. The advancing sheet is detected by the photocell 110, which holds the motor deactivated until the sheet is moved by the conveyor beyond the site of the photocell. The sequence is then repeated to deliver another sheet from the stack onto the conveyor belt.

Alternatively, the illustrated embodiment of the apparatus can be operated in a continuous fashion without the photocell or only using the photocell as a counter. In this mode, the speed of the drive means 42 and the conveyor belt B speed must be coordinated so that sheets fall on the belt at desired intervals.

During the sheet feeding operation, it is preferred that the gap formed at the nip 52 be adjusted such that the lowermost sheet of the stack is free to pass through the nip 52 without engaging the bar 62 and thus without significant frictional resistance, while the sheet immediately above the lowermost sheet engages the bar 62 of the roll 51 and is retarded by the increased frictional resistance provided by the bar. Thus the sheets above the lowermost sheet are held substantially stationary in the stack. Also, the rear support member 34 is positioned so as to lift the rear side of the stack from the upper run of the three endless belts 30 and rollers 33 such that the sheets in the stack above the lowermost sheet will only contact the upper run after the lowermost sheet has entered the nip. Thus the sheets are reliably fed in a serial manner from the bottom of the stack and until all of the sheets in the stack have been delivered onto the conveyor belt B.

The apparatus may also be operated to provide for the shingling of the sheets being fed. In this regard, it will be understood that the peripheral surface on the side of the roll 51 facing the stack is smooth so as to offer very little resistance as the sheets form around the surface and are guided to the nip 52. The nip is adjusted to allow the lowermost sheet to freely pass between the bar 62 and the lower drive belt 30 and rollers 33. The second sheet which is immediately above the lowermost sheet meets the resistance of the bar 62 at the nip and is held in place until the lower sheet has fed out enough to allow contact with the underlying drive belt system which then drives the second sheet forward into a tight fit in the nip. The trailing edge of the lowermost sheet passes the nip and the second sheet continues to drive forward, thus allowing shingling. This system makes this feeder very tolerant of open edge leading products and slick sheets.

For shingling, the distance of the bar 62 from the drive rollers 33 is preferably about one and one-half times the thickness of the paper being fed. The bar thus retards the overlying second sheet while having minimum contact with the underlying first sheet.

It will be apparent that the contact between the advancing sheets and the elastomeric bar 62 at the nip will in time cause the bar to wear and become less effective. One of the advantages of the present invention resides in the fact that the bar may be easily removed from the groove 58 and replaced or may be removed, turned to the opposite side and reused.

In the drawings and specification, there has been disclosed a preferred embodiment of the invention and, although specific terms are employed, they are used in a generic and descriptive sense only and not for purposes of limitation, the scope of the invention being set forth in the following claims.

That which is claimed is:

1. An apparatus for serially feeding sheets in a forward direction from the bottom of a generally vertical stack of such sheets and comprising:

a frame, means mounted to said frame for supporting the generally vertical stack of sheets and so that the stack defines a forward side composed of aligned forward edges of the sheets, and a bottom, said supporting means including endless belt means and means rotatably mounting said endless belt means so as to have an upper run positioned to extend across the bottom of said stack;

drive means for rotating said endless belt means so that said upper run moves in the forward direction;

a gate forming member positioned above said upper run of said belt means and adjacent the forward side of said stack and so as to define a nip which forms a gap between said gate forming member and said upper run for permitting the lowermost sheet of the stack to pass forwardly from the stack through said nip, said gate forming member comprising a generally cylindrical roll defining a central axis and an outer peripheral surface which is concentric to said central axis, said outer peripheral surface having a groove extending axially along the length thereof and which is positioned so as to generally oppose said nip, with said groove defining opposing parallel side walls and a bottom wall, and a bar disposed in said groove, with said bar being composed of a material having a higher coefficient of friction than the material of said roll and including parallel opposite side edges and being sized so that the opposite side edges are pressed into engagement with said opposing side walls of said groove and a portion of said bar extends beyond said peripheral surface of said nip, and means adjustably mounting said gate forming member to said frame so as to permit the dimension of said nip to be adjusted, and whereby the gate forming member may be adjustably positioned so that the lowermost sheet is free to pass through said nip without significant engagement with said bar and thus without significant frictional resistance while the sheet immediately above the lowermost sheet engages said bar and is frictionally engaged thereby.

2. The apparatus as defined in claim 1 wherein said means rotatably mounting said endless belt means includes a pair of spaced apart support shafts mounted for rotation about parallel axes and having said endless belt means entrained thereabout.

3. The apparatus as defined in claim 2 wherein said endless belt means comprises a plurality of endless belts, and a pair of aligned support rolls mounted on respective ones of said support shafts and mounting each of said endless belts, and a plurality of drive rolls mounted on each of said support shafts, with at least one of said drive rolls being positioned between adjacent endless belts, and with the diameter of said support rolls being less than the diameter of said drive rolls so that said drive rolls have an outer surface which is substantially coextensive with the outer surface of said endless belts.

4. The apparatus as defined in claim 3 wherein one of said support shafts is aligned with said cylindrical roll of said gate forming member so that the drive rolls on said one support shaft are aligned across the nip from said cylindrical roll.

5. The apparatus as defined in claim 1 further comprising sheet guide means positioned downstream of and in registry with said nip for guiding the sheets forwardly after advancing through said nip.

6. The apparatus as defined in claim 5 wherein said sheet guide means comprises a guide roller mounted for rotation about a fixed axis disposed parallel to said axes of said support shafts, with the upper portion of said guide roller being substantially coplanar with said upper run of said belt means and transmission means operatively connected between said drive means and said guide roller for rotating said guide roller at a peripheral speed corresponding to the speed of said endless belt means.

7. The apparatus as defined in claim 6 wherein said transmission means comprises a plurality of guide belts and rollers entrained about said one support roll and said guide roll, with said guide belts having an upper run which is substantially coplanar with said upper run of said endless belt means.

8. The apparatus as defined in claim 7 wherein said sheet guide means further comprises a clamping roller, and means mounting said clamping roller for free rotation about an axis parallel to the axis of said guide roller and so that said clamping roller rests upon the peripheral surface of said guide roller.

9. The apparatus as defined in claim 5 further including a sheet guiding member positioned downstream from said sheet guide means and said nip, said sheet guiding member having a downwardly inclined surface portion for engaging the leading edge of each delivered sheet and guiding the same to a predetermined area.

10. The apparatus as defined in claim 1 wherein said portion of said bar which extends beyond said outer peripheral surface includes a rearwardly facing edge surface which extends generally along a tangent to said outer peripheral surface.

11. The gate forming member as defined in claim 10 wherein said bar has a quadrilateral cross sectional configuration which comprises said parallel opposite side edges and inclined upper and bottom edges, and with one of said upper and bottom edges defining said edge surface, and whereby said bar may be removed and replaced in said groove so that the other of said upper and bottom edges defines said edge surface.

12. The apparatus as defined in claim 1 further comprising means adjustably mounting said gate forming member so as to permit the dimension of said nip to be adjusted and such that said gate forming member may be readily removed from the remainder of said apparatus.

13. The apparatus as defined in claim 12 wherein said apparatus further comprises a frame including a support bracket which is positioned above said nip, and said means adjustably mounting said gate forming member comprises a road fixed to said roll at a central portion thereof and such that the rod extends radially upwardly from said nip, and means interconnecting said rod to said support bracket so as to permit limited movement therebetween and to permit the dimension of said nip to be adjusted, and spring biasing means surrounding said rod for biasing said roll toward said nip and form permitting limited movement of said roll away from said nip and against the force of said spring biasing means.

14. The apparatus as defined in claim 1 further comprising sensing means for sensing the presence or absence of a sheet exiting said nip.

15. The apparatus as defined in claim 14 further comprising means operatively interconnecting said sensing means with said drive means so as to actuate said drive means when no sheet is sensed by said sensing means.

16. The apparatus as defined in claim 14 wherein said sensing means comprises a photocell.

17. The apparatus as defined in claim 14 wherein said sensing means stops said drive means from operating upon having sensed a predetermined number of sheets passing through said nip.

18. A gate forming member for use with an apparatus for serially feeding sheets in a forward direction from the bottom of a generally vertical stack of such sheets and comprising:

a generally cylindrical roll defining a central axis and an outer peripheral surface which is concentric to said central axis, said outer peripheral surface having a groove extending axially along the length thereof, with said groove defining opposing parallel side walls and a bottom wall, and a bar disposed in said groove, with said bar being composed of a material having a higher coefficient of friction than the material of said roll and including parallel opposite side edges and being sized so that the opposite side edges are pressed into engagement with said opposing side walls of said groove and a portion of said bar extends beyond said peripheral surface, said portion of said bar which extends beyond said outer peripheral surface including an edge surface which extends generally along a tangent to said outer peripheral surface, and wherein said bar has a quadrilateral cross section configuration which comprises said parallel opposite side edges and inclined upper and bottom edges, and with one of said upper and bottom edges defining said edge surface, and whereby said bar may be removed and replaced in said groove so that the other of said upper and bottom edges defines said edge surface.

19. The gate forming member as defined in claim 18 wherein said roll is composed of a material having a coefficient of friction of about 0.15 to 0.35, and said bar is composed of an elastomeric material having a coefficient of friction of about 0.5 to 0.7.

20. The gate forming member as defined in claim 18 wherein said roll includes a threaded radial opening at a central position along its axial length, for facilitating the mounting of said roll.

21. The gate forming member as defined in claim 20 wherein said roll further includes mounting posts extending from opposite ends of said roll and with said mounting posts being coaxially aligned with said central axis.

22. An apparatus for serially feeding sheets in a forward direction from the bottom of a generally vertical stack of such sheets and comprising:

means for supporting the generally vertical stack of sheets and so that the stack defines a forward side composed of aligned forward edges of the sheets, and a bottom, said supporting means including endless belt means and means rotatably mounting said endless belt means so as to have an upper run positioned to extend across the bottom of said stack;

drive means for rotating said endless belt means so that said upper run moves in the forward direction;

a gate forming member positioned above said upper run of said belt means and adjacent the forward side of said stack and so as to define a nip which forms a gap between said gate forming member and said upper run for permitting the lowermost sheet of the stack to pass forwardly from the stack through said nip, said gate forming member comprising a generally cylindrical roll defining a central axis and an outer peripheral surface which is concentric to said central axis, said outer peripheral surface having a groove extending axially along the length thereof and which is positioned so as to generally oppose said nip, with said groove defining opposing parallel side walls and a bottom wall, and a bar disposed in said groove, with said bar being composed of a material having a higher coefficient of friction than the material of said roll and including parallel opposite side edges and being sized so that the opposite side edges are pressed into engagement with said opposing side walls of said groove and a portion of said bar extends beyond said peripheral surface at said nip and is spaced from said endless belt means, and whereby the lowermost sheet is free to pass through said nip without significant engagement with said bar and thus without significant frictional resistance while the sheet immediately above the lowermost sheet engages said bar and is frictionally engaged thereby, said portion of said bar which extends beyond said outer peripheral surface including an edge surface which extends generally along a tangent to said outer peripheral surface, and wherein said bar has a quadrilateral cross sectional configuration which comprises said parallel opposite side edges and inclined upper and bottom edges, and with one of said upper and bottom edges defining said edge surface, and whereby said bar may be removed and replaced in said groove so that the other of said upper and bottom edges defines said edge surface.

* * * * *

UNITED STATES PATENT AND TRADEMARK OFFICE

CERTIFICATE OF CORRECTION

PATENT NO. : 5,143,365

DATED : September 1, 1992

INVENTOR(S) : Ronald J. Green

It is certified that error appears in the above-identified patent and that said Letters Patent is hereby corrected as shown below:

Column 3, line 50, after "below" insert -- . --.

Column 8, line 24, "of" should be -- at --.

Column 9, line 43, "road" should be -- rod --.

Column 9, line 49, "form" should be -- for --.

Column 10, lines 18 and 19, "section" should be -- sectional --.

Signed and Sealed this

Twenty-eighth Day of September, 1993

Bruce Lehman

*Attest:*

BRUCE LEHMAN

*Attesting Officer*

*Commissioner of Patents and Trademarks*